United States Patent [19]

Lewis et al.

[11] 4,003,201

[45] Jan. 18, 1977

[54] VARIABLE AREA FLAMEHOLDER DUCT

[75] Inventors: George D. Lewis, North Palm Beach; Norman W. Mangum, Jr., Palm Beach Gardens; James P. Rusnak, North Palm Beach, all of Fla.

[73] Assignee: United Technologies Corporation, Hartford, Conn.

[22] Filed: July 31, 1975

[21] Appl. No.: 600,531

[52] U.S. Cl. ..... 60/262; 60/39.72 R; 60/271

[51] Int. Cl.[2] ..... F02C 7/22

[58] Field of Search ..... 60/39.72 R, 261, 270 R, 60/263, 224, 262, 271

[56] References Cited

UNITED STATES PATENTS

| | | | |
|---|---|---|---|
| 2,910,828 | 11/1959 | Meyer et al. | 60/261 |
| 3,386,248 | 6/1968 | Pike et al. | 60/261 |
| 3,412,560 | 11/1968 | Gaubatz | 60/261 |
| 3,633,362 | 1/1972 | Sotheran et al. | 60/39.72 R |
| 3,715,079 | 2/1973 | Thompson | 60/261 |
| 3,730,436 | 5/1973 | Madden et al. | 60/242 |
| 3,792,815 | 2/1974 | Swavely et al. | 60/242 |

*Primary Examiner*—Carlton R. Croyle
*Assistant Examiner*—Robert E. Garrett
*Attorney, Agent, or Firm*—Jack N. McCarthy

[57] ABSTRACT

An annular ram burner has a movable wall adjacent the flameholder to provide a large variation in area change at the flameholder plane. The movable wall comprises a number of flaps mounted around the ram burner. While a ram burner is shown a fan duct burner can also be used. The flaps are attached to an actuator mechanism through a linkage system which allows the wall to be moved rapidly and to be simply controlled by an engine control device, substantially in the same manner that the variable area exhaust nozzle is controlled. The flaps further are provided with a liner so that cooling air is directed therethrough to an annular liner around the combustion chamber.

7 Claims, 2 Drawing Figures

VARIABLE AREA FLAMEHOLDER DUCT

The invention herein described was made in the course of or under a contract with the United States Department of the Air Force.

BACKGROUND OF THE INVENTION

This invention relates generally to the field of fan duct burning and ram burning engines, and more particular to annular fan duct burners and ram burners which must perform effectively over a wide range of operation condition. The usual fan duct burning and ram burning engine has flameholding characteristics for a given operating condition determined by a large degree by the dynamics at the flameholder plane, which are in turn determined by flameholder plane geometry. The geometry at the flameholder plane is normally fixed and for this reason the operating range of the fan duct burner and ram burner is limited to a narrow band around the design point of the burner.

SUMMARY OF THE INVENTION

A principal object of the present invention is to provide a fan duct engine or ram burning engine having a diffuser, spraybar and flameholder system and a variable nozzle in combination with a modification to the burner wall at the flameholder plane for controlling the flameholding stability characteristics of the system.

Another object of the present invention is to provide a movable wall adjacent the flameholder which comprises a plurality of flaps mounted around the combustion chamber of the fan duct burning engine or ram burning engine.

A further object of the invention is in the control system wherein the actuation of the movable wall is coordinated with the actuation of the variable exhaust nozzle so that as the variable exhaust nozzle opens or closes and the duct Mach number at the flameholder plane increases or decreases the movable wall will open or close to provide the necessary pressure drop at the flameholder plane to stabilize the combustion process yet not penalize the system with excessive pressure drop when it is not required.

Another object of the invention is to provide a movable wall wherein cooling flow is directed therethrough into a cooling liner around the combustion chamber without permitting the cooling flow directly through the flaps in the combustion chamber.

DESCRIPTION OF THE PREFERRED EMBODIMENT

Figure 1:
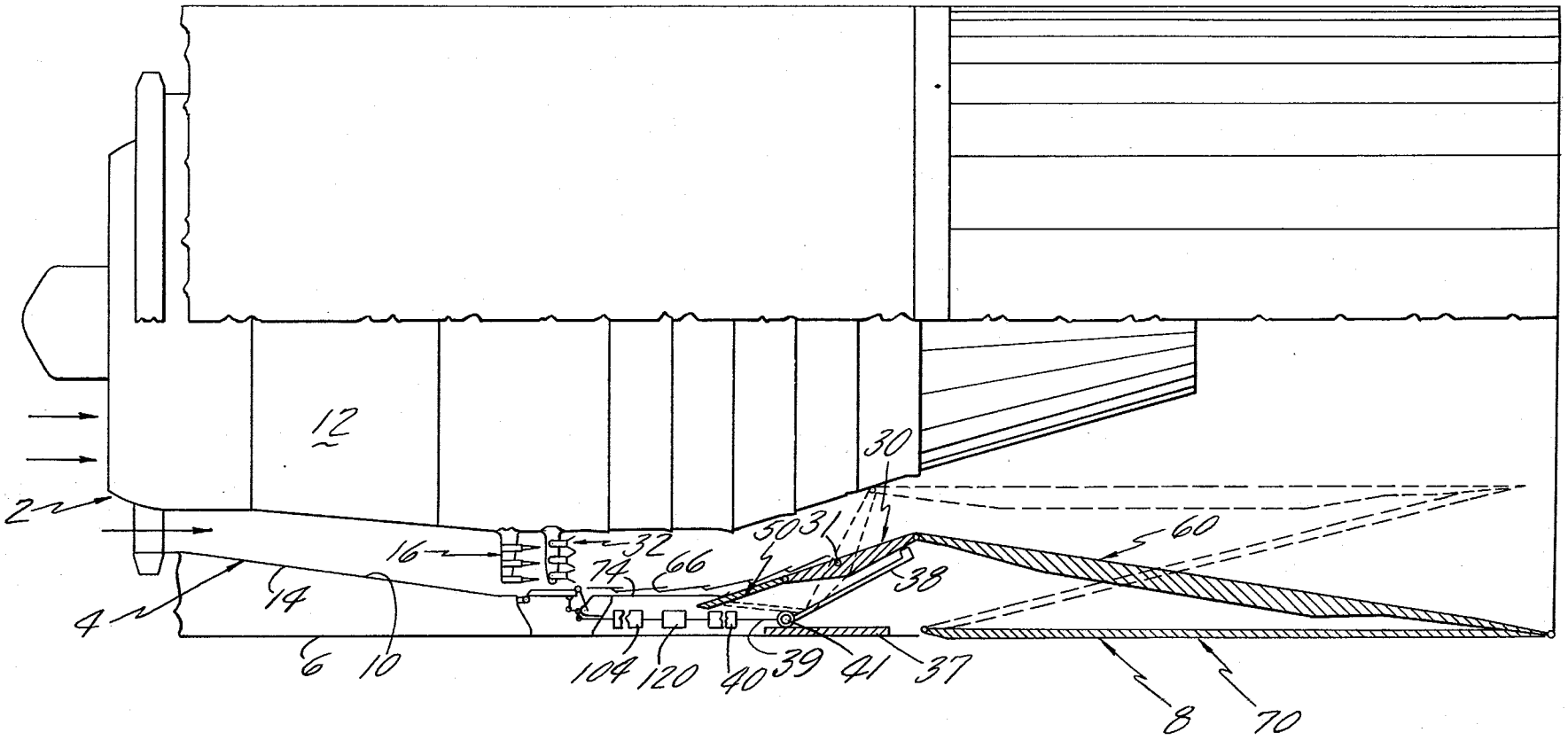
FIG. 1 is a view showing a core engine having a duct burning wrap around engine showing the location of the invention.

As viewed in FIG. 1, a powerplant is shown having a core engine 2 with a wrap around duct burning engine 4. An outer casing 6 envelopes the powerplant with a nozzle 8 being fixedly mounted in relation thereto at the downstream end thereof. This type of nozzle and its actuating mechanism is shown in U.S. Pat. No. 3,730,436.

The duct burning engine has an annular inlet section 10 formed between an outer casing 12 on the core engine and an outer wall 14 extending therearound. Fuel injection means 16 is located in the duct burning engine at the rear end of said annular passageway 10 and consists of a plurality of radial extending bars 18 which support three annular sprayrings 20, 24 and 26. Fuel is delivered to these sprayrings by a control not shown in a manner so that fuel can be directed to any of the sprayrings individually or to any combination thereof. This provides for zone burning within the duct burning engine.

Immediately downstream of the fuel injection means 16 is a flameholding means 32. The flameholding means 32 comprises a plurality of radially extending rods 34 which support three annular U-shaped flameholder rings 36, 38 and 42. These annular flameholder rings 36, 38 and 42 are located a small distance radially inwardly from the three annular sprayrings 20, 24 and 26, respectively. This substantially aligns each flameholder ring with the fuel spray which emits from the top of the sprayrings at locations A, B and C.

Starting at the flameholding means 32 an annular combustion chamber 62 is formed having an inner annular line 64 and an outer annular liner 66, an inner wall 68 formed as an extension of the outer casing 12 provides for an annular cooling passageway 72, and an outer wall 74 extends around the outer annular liner 66 and forms a downstream extension of the outer wall 14. A cooling passageway 76 is formed between the outer annular liner 66 and outer wall 74. An annular opening 44 is located between the rearward end of outer wall 14 and the forward end of outer wall 74.

The annular opening 44 opens into an annular manifold 46. Annular manifold 46 is formed between annular flanges 48 and 52 and a portion of the outer casing 6. Annular flange 48 extends between the rear end of outer wall 14 to outer casing 6 and annular flange extends between a point adjacent the forward end of outer wall 74 and outer casing 6.

Figure 2:
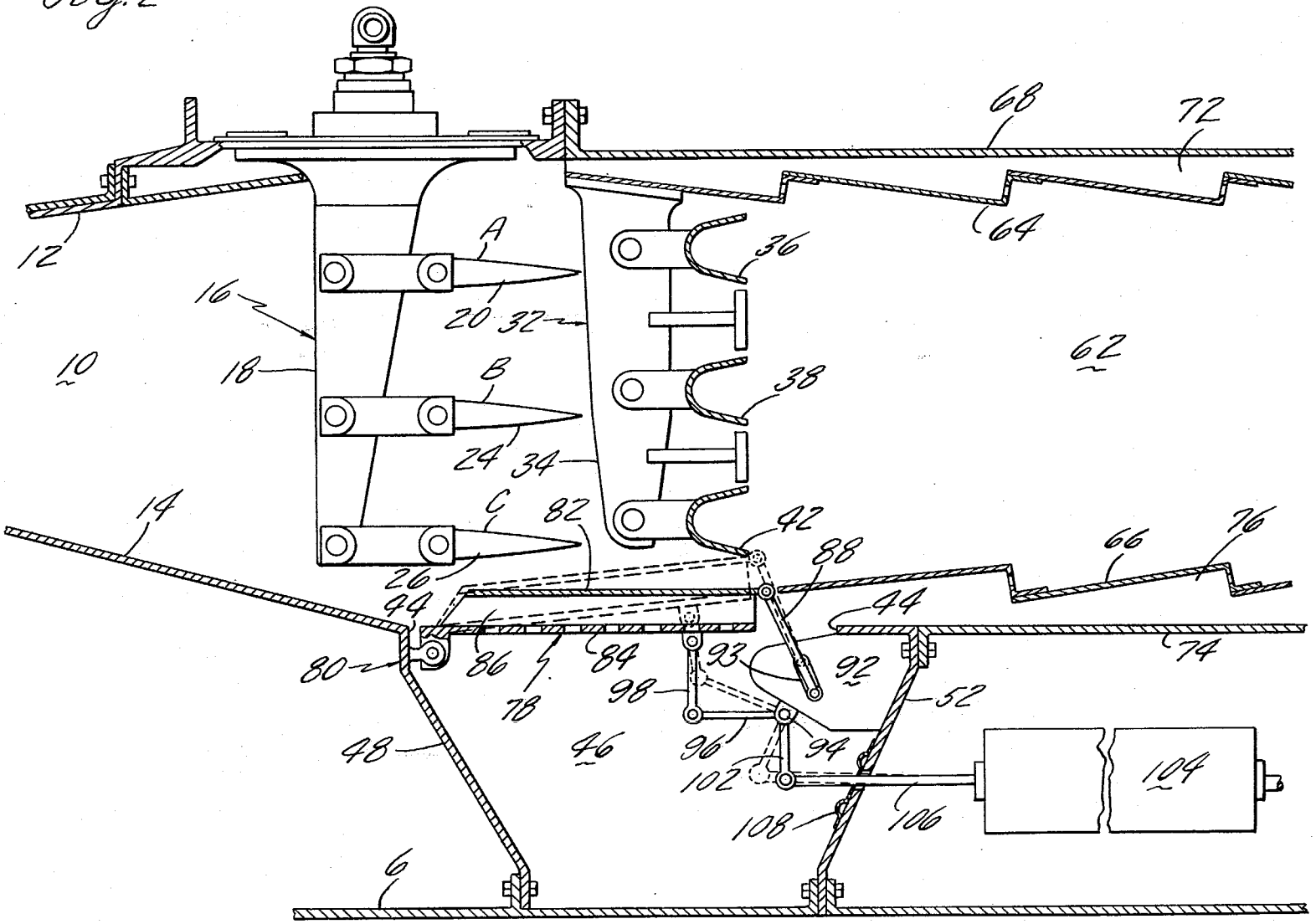
FIG. 2 is an enlarged view showing the fuel sprayrings and flameholder with the outer adjacent wall being movable.

A plurality of flaps 78 extend around the annular opening 44 and each flap is pivoted to the annular flange 48 at 80. Each flap 78 is formed of an inner solid wall 82 and an outer perforated wall 84. These walls are connected at their midpoint by a lengthwise rib 86. The ends of adjacent flaps overlap each other and have a movement therebetween such as an iris shutter when the flaps are moved between an outer and inner position. If desired, other sealing means can be used between adjacent flaps 78. In FIG. 2 the flaps are shown in their outer position with the passageway through the flaps 78 aligned with the passageway 76 formed between the outer liner 66 and outer wall 74 to direct a cooling flow thereto. To prevent the air flowing through the flaps from being dumped into a combustion chamber 62, end flaps 88 are provided on each of the flaps 78 to provide a sealing action with the forward end of the outer annular liner 66. As the flaps 78 move between their inner and outer positions the flaps 88 move therewith to direct any flow through the flaps downwardly into the annular manifold 46.

The free end of the flaps 88 are cammed to maintain a sealing effect with the forward end of the annular liner 66. The free ends of the flaps 88 each have a cam follower positioned in a camming means 93 located in a bracket 92 extending forwardly from the outer wall 74 and annular flange 52. A bracket 94, one for each flap 78, is also supported by the brackets 92 for supporting a bellcrank 96 which has one end connected by a link 98 to a bracket on the rearward end of each flap 78 and its other end connected to actuator 104 by an actuating rod 106. It can be seen that as the actuating rod 106 is moved between its solid and dotted positions through each bellcrank 96, a seal 108 is provided on annular flange 52 for each actuating rod 106 where it passes therethrough.

It can be seen that when the flaps 78 are in their outer position, cooling air will flow through each flap 78 into the annular manifold 46 where it will flow around the end of flaps 88 into passageway 76. As the flaps move from their outer position to their inner position, the cooling air will continue to flow through the flaps 78 around the flaps 88 to the passageway 76 without being dumped into the combustion chamber 62.

As seen in FIG. 1 the outer annular liner 66 extends rearwardly to a point adjacent the pivotal point 31 of the convergent flaps 30 and the outer wall 74 extends to a position adjacent the balance flaps 50 where they form a sealing engagement therewith. The diverging flaps 60 have their front ends pivotally mounted to the rear ends of the converging flaps 30 and the rear ends of the diverging flaps 60 have their rear ends pivoted to the rear ends of outer casing flaps. The forward ends of the casing flaps 70 are pivoted to the outer casing 6. An actuating mechanism including an actuator 40 and an actuating rod 39 moves a synchronizing ring 41 on tracks 37 to actuate the converging flaps 30 by rods 38. Here again, this nozzle and its actuation is disclosed in detail in U.S. Pat. No. 3,730,436. It is also shown in U.S. Pat. No. 3,792,815. A control 120 controls the movement of the actuator 104 and actuator 40. The movement is coordinated so that when said nozzle provides a maximum duct Mach number, said flaps 78 provide a minimum flow area at the flameholder plane. The system flameholding characteristics can therefore be controlled by varying the flow area at the flameholder plane which allows a burner to perform over a wide range of operating conditions which would not be possible in a fixed geometry system. In operation for example, the flaps 78 are moved into the flow stream at the flameholder plane during low flight Mach number operation when a higher pressure loss is required to maintain flameholding stability, and the flaps 70 are then withdrawn from the flow stream as the flight Mach number increases until at the maximum flight Mach number they are fully withdrawn. By operating in this previously described manner only the required pressure loss for system flameholding stability is maintained without paying a pressure loss penalty at other operating conditions.

We claim:

1. An air breathing reaction propulsion engine, said engine having a combustion chamber with combustion occurring in said chamber at subsonic air velocities, fuel injection means for injecting fuel into said combustion chamber, flameholder means in said combustion chamber, a variable area exhaust nozzle, a wall of said combustion chamber being movable to vary the effective flow area of the combustion chamber across the flameholder, a portion of said wall being located in radial alignment with said flameholder.

2. A combination as set forth in claim 1 wherein said combustion chamber is annular.

3. A combination as set forth in claim 1 including an actuating device for operating said movable wall, a second actuating device for operating said variable area exhaust nozzle, control means for controlling said first and second actuating devices so that when said nozzle provides a maximum duct Mach number said movable wall provides a minimum flow area at the plane of the flameholder means.

4. A combination as set forth in claim 1 wherein said combustion chamber has a wall therearound to provide a cooling passage, said movable wall is formed as a passageway to deliver cooling air to the cooling passage of said combustion chamber.

5. A combination as set forth in claim 1 wherein said movable wall comprises a plurality of flaps pivoted at their forward end.

6. A combination as set forth in claim 5 wherein the rearward end of said flaps have second flap means for preventing the flow of cooling air in said movable wall from entering the combustion chamber.

7. A combination as set forth in claim 6 wherein the free end of said second flap means is guided by cam means to maintain a seal with the edge of the combustion chamber just downstream of said movable wall.

* * * * *